US012247797B2

(12) United States Patent
Eck

(10) Patent No.: US 12,247,797 B2
(45) Date of Patent: Mar. 11, 2025

(54) COOLING DEVICE FOR A GUN BARREL

(71) Applicant: Eck Fabrication LLC, Kingman, KS (US)

(72) Inventor: Ethan Eck, Kingman, KS (US)

(73) Assignee: Eck Fabrication LLC, Kingman, KS (US)

( * ) Notice: Subject to any disclaimer, the term of this patent is extended or adjusted under 35 U.S.C. 154(b) by 0 days.

(21) Appl. No.: 18/439,874

(22) Filed: Feb. 13, 2024

(65) Prior Publication Data

US 2024/0271896 A1 Aug. 15, 2024

Related U.S. Application Data

(60) Provisional application No. 63/445,798, filed on Feb. 15, 2023.

(51) Int. Cl.
*F41A 13/10* (2006.01)

(52) U.S. Cl.
CPC ..... *F41A 13/10* (2013.01)

(58) Field of Classification Search
CPC ..... F41A 13/10; F41A 13/12; F41A 21/24
USPC ..... 89/14.1
See application file for complete search history.

(56) References Cited

U.S. PATENT DOCUMENTS

| | | | | |
|---|---|---|---|---|
| 1,242,890 | A | 10/1917 | Sheppard | |
| 1,337,971 | A * | 4/1920 | Watkins | F41A 9/46 89/13.05 |
| 1,413,903 | A | 4/1922 | Czegka | |
| 1,527,585 | A | 2/1925 | Morgan et al. | |
| 1,631,190 | A * | 6/1927 | Bull | F41A 13/12 89/14.1 |
| 2,205,426 | A * | 6/1940 | Lochhead | F41A 13/12 89/14.1 |
| 7,143,821 | B2 | 12/2006 | Meissner et al. | |
| 8,783,154 | B1 * | 7/2014 | Windham | F41A 13/12 89/14.1 |
| 11,118,857 | B2 | 9/2021 | Griffin et al. | |
| 2010/0192759 | A1 * | 8/2010 | Garwood | F41A 13/12 89/12 |
| 2016/0356567 | A1 * | 12/2016 | Bybee | F41C 23/16 |
| 2018/0120044 | A1 | 5/2018 | Lagenbeck | |
| 2018/0252447 | A1 * | 9/2018 | Rockenfeller | B01J 20/046 |

FOREIGN PATENT DOCUMENTS

| | | | |
|---|---|---|---|
| ES | 2184574 | A1 | 4/2003 |
| GB | 104530 | A | 3/1917 |
| GB | 118808 | A | 9/1918 |
| GB | 702878 | A | 1/1954 |

(Continued)

OTHER PUBLICATIONS

International search report for the application No. PCT/US2024/015355 dated May 7, 2024.

*Primary Examiner* — Bret Hayes
(74) *Attorney, Agent, or Firm* — Thompson Coburn LLP

(57) ABSTRACT

A cooling device for a gun barrel has a muzzle assembly. The muzzle assembly has a shaft, a baffle, a turbine assembly, a compressor assembly, and a rotary drive tube. The rotary drive tube connects the turbine assembly to the compressor assembly. A heat exchanger may be releasably connected to the cooling device. A diffuser or muzzle device may be arranged downstream of the turbine assembly.

20 Claims, 19 Drawing Sheets

(56) References Cited

FOREIGN PATENT DOCUMENTS

| | | | |
|---|---|---|---|
| RU | 2015486 | C1 | 6/1994 |
| RU | 2646980 | C1 | 3/2018 |
| WO | 2016205838 | A1 | 12/2016 |

* cited by examiner

COOLING DEVICE FOR A GUN BARREL

RELATED APPLICATION DATA

This application claims priority benefit to U.S. provisional application Ser. No. 63/445,798, filed Feb. 15, 2023, the disclosure of which is incorporated by reference herein.

BACKGROUND AND SUMMARY

This disclosure pertains to a cooling device for a gun barrel.

One aspect of the disclosure is a cooling device for a gun barrel. The cooling device comprises a muzzle assembly, and may include a heat exchanger and a shield attached to the muzzle assembly.

The muzzle assembly has a shaft, a baffle, a diffuser plate, a compressor assembly, and a rotary drive tube. The shaft has a first end and an axial opposite second end with a length between the first and second ends. The second end of the shaft is adapted and configured to releasably connect to an end of a gun barrel. The shaft has a bore, which is adapted and configured to allow a round discharged from the gun to pass through the shaft from the second end of the shaft to the first end of the shaft. The baffle is operatively connected at the first end of the shaft.

The turbine assembly is operatively connected to the shaft adjacent the first end of the shaft. The turbine assembly has a plurality of turbine blades downstream of the baffle and the first end of the shaft. The plurality of turbine blades are adapted and configured to rotate relative to the shaft and allow passage of the round therethrough.

The diffuser plate is downstream of the turbine assembly. The diffuser plate has outlet openings, which are adapted and configured to direct a flow of propellant gases from the baffle and turbine away from the muzzle assembly and the cooling device. The diffuser plate has a muzzle opening coaxially aligned with and spaced from the first end of the shaft and adapted to allow passage of the round therethrough.

The compressor assembly is operatively connected to the shaft and disposed between the first end of the shaft and the second end of the shaft. The compressor assembly has a plurality of compressor blades. The compressor blades are adapted and configured to rotate relative to the shaft.

The rotary drive tube is operatively connected to a radially outward region of at least one turbine blade and a radially outward region of at least one compressor blade. The rotary drive tube is adapted and configured to rotate relative to the shaft and rotate with the plurality of a turbine blades and the plurality of compressor blades. The rotary drive tube has a plurality of outlet vents downstream of the plurality of compressor blades.

The heat exchanger may be arranged upstream of the muzzle assembly and may be operatively connected therewith adjacent the second end of the shaft. The heat exchanger comprises an intake and a discharge and at least one cooling fin. The intake is adapted and configured to direct a cooling media onto the at least one cooling fin, the discharge is aligned with and adapted and configured to direct a cooling media, for instance, ambient air, from the at least one cooling fin to the plurality of compressor blades.

The shield may be operatively and selectively repositionally connected to the muzzle assembly. The shield may be arranged radially outward of the rotary drive tube and may be adapted and configured to selectively directionally deflect effluent from the outlet vents of the rotary drive tube away from the muzzle assembly.

Further features and advantages, as well as the operation, are described in detail below with reference to the accompanying drawings.

Figure 1:
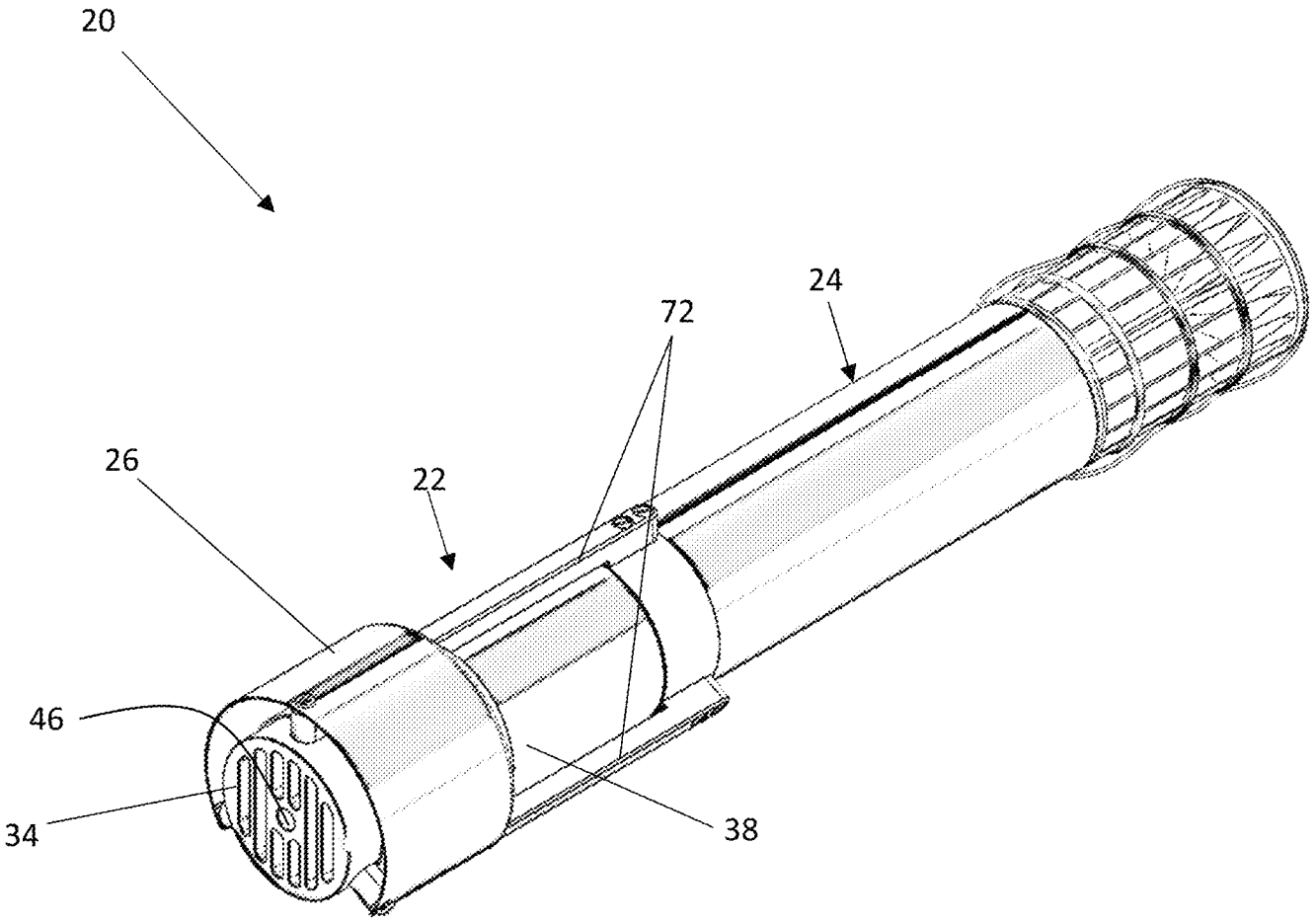
FIG. 1 is a perspective view of a gun barrel cooling device including a muzzle assembly, a heat exchanger upstream of the muzzle assembly, a shield supercircumjacent the muzzle assembly with the shield configured to direct an effluent cooling media downward away from the muzzle assembly.

Reference numerals in the written specification and in the figures indicate corresponding items.

DETAILED DESCRIPTION

An embodiment of a cooling device for a barrel of a gun, generally indicated by reference number 20, is shown in FIGS. 1-8. The cooling device 20 may comprise a muzzle assembly 22, and optionally may include a heat exchanger 24, and optionally may include a shield 26. Although the cooling media shown herein comprises ambient air, the cooling media may comprise a liquid that may be pumped and circulated through the muzzle assembly 22, and the heat exchanger 24 when provided. The liquid may be a water based coolant or an oil based coolant.

As shown in the drawings, the muzzle assembly 22 may have a shaft 28, a baffle 30, a turbine assembly 32, a diffuser plate 34, a compressor assembly 36, and a rotary drive tube 38. The diffuser plate may be optionally provided and may be omitted depending upon the application. The shaft 28 has a first end 28*a* and an axial opposite second end 28*b* with a length L between the first and second ends. The second end 28*b* of the shaft 28 may be adapted and configured to releasably connect to an end of gun barrel (not shown). For instance, the second end 28*b* of the shaft 28 may be threadably connected to the distal end of the gun barrel or may be connected with a mechanical fastener or other modular connection. In the alternative, the shaft and/or one or more components of the muzzle assembly described herein may be integrally constructed or monolithic with the gun barrel and adapted to readily accept other components such as bearings, turbine or compressor blades, baffles, etc. The shaft 28 has a bore 40, which is adapted and configured to allow a round/projectile (not shown) discharged from the gun (not shown) to pass through the shaft 28 from the second end of the shaft 28*b* to the first end of the shaft 28*a*. Thus, the shaft 28 in effect comprises an extension of the gun barrel. The second end 28*b* of the shaft may include a radially outward projecting boss 68 with one or more extensions 70 projecting radially outward therefrom. The boss 68 may accommodate a counterbore with a structure for engaging the distal end of the gun barrel. The boss extension 70 may provide a connection point for struts 72 that extend along a length of the muzzle assembly 22 and orient the diffuser plate 34 in a spaced apart arrangement from the first end 28*a* of the shaft and the baffle 30. The struts 72 and boss extension 70 and outward projecting boss 68 may be integrally or monolithically formed. Cooling media driven by the compressor may circulate into the muzzle assembly 22 and from the heat exchanger 24 when provided. Accordingly, the cooling media may flow from the heat exchanger 24 into the muzzle assembly 22 and may flow over the boss 68 between the extensions 70 into the interior of the muzzle assembly. The shield 26 may have a plurality of connection holes equiangularly spaced about the shield to allow the shield to be selectively removed and repositionally arranged on and connected with the struts 72, and the muzzle assembly 22 in general, via mechanical fasteners.

The baffle 30 may be operatively connected at the first end 28*a* of the shaft 28. The baffle 30 may be conically shaped and expand outward downstream of the first end 28*a* of the shaft. As will become evident from the discussion that follows, propellant gases from the round/projectile being discharged from the gun that exit from the first end 28*a* of the shaft 28 may be deflected by the baffle 30 toward the blades of the turbine assembly 32 to cause the blades of the turbine assembly to rotate relative to the shaft 28. The baffle may be perforated to allow a portion of the effluent from the compressor to flow through the perforations and mix with the propellant gases.

The turbine assembly 32 may be operatively connected to the shaft 28 adjacent the first end of the shaft 28*a*. The turbine assembly 32 may have a plurality of turbine blades 42 downstream of the baffle 30 and the first end of the shaft 28*a*. The plurality of turbine blades 42 may be adapted and configured to rotate relative to the shaft 28 and allow passage of the round (not shown) through the center of the blades. The turbine blades 42 may be arranged to be driven by the expanding, high velocity propellant gases exiting from the first end 28*a* of the shaft and being deflected by the baffle 30 upon discharge of a round from the gun. The turbine assembly 32 may further comprise a turbine bearing 64. The turbine bearing 64 may include an inner race that is operatively fixed to the shaft 28 and an outer race operatively connected to a cup shaped body 74 that extends upstream around and over the baffle 30. The cup shaped body 74 may have a tubular region that projects upstream of the baffle 30. The cup shaped body may extend to and/or overlap with a portion of the diffuser plate with a clearance between the cup shaped body and the diffuser plate that allows a portion of the propellant gases to pass over the outer diameter surface of the diffuser plate. When the turbine blades are spaced from the diffuser plate, the cup shaped body may act as a conduit to direct propellant gases to the diffuser plate. The blades 42 of the turbine assembly 32 may extend radially inward from an inner surface of the tubular region with an open center to accommodate the travel of the round/projectile discharged from the gun. The inner race and/or outer race of the turbine bearing 64 may include one or more flinger structures configured to prevent the ingress of debris into the bearing. The flinger structure may also provide circulation of the cooling media around the turbine assembly 32, and in particular, the bearing 64 for cooling the bearing. Cooling fins may be provided on the turbine bearing 64 or turbine assembly 32 for additional cooling. In this way, the turbine assembly 32 may be adapted and configured to allow the cooling media to cool the turbine bearing 64. The bearing 64 may be contained in a housing. Rotation elements of the bearing 64 may be lubricated. Lubrication may include grease. Lubrication may include oil from sump located in the housing that is circulated via a pumping member driven from rotation of the outer race. The turbine assembly 32, and in particular, the turbine blades 42, may be configured to act as a suppressor by reducing the velocity of propellant gases and converting a portion of the energy of the propellant gases into rotational energy of the turbine blades 42 to thereby minimize the sound caused by such exiting propellant gases.

The diffuser plate 34 may be downstream of the turbine assembly 32. As shown in the drawings, the diffuser plate is positioned immediately adjacent to the turbine assembly. Depending upon the application the diffuser plate may be spaced from the turbine assembly, or the diffuser plate may be omitted. The diffuser plate 34 may have outlet openings 44, which are adapted and configured to direct a flow of propellant gases from the baffle 30 and turbine assembly 32 away from the muzzle assembly 22 and the cooling device 20. The diffuser plate 34 may have a muzzle opening 46 coaxially aligned with and spaced from the first end of the shaft 28*a* and adapted to allow passage of the round/projectile (not shown) therethrough. The outlet openings 44 of the diffuser plate 34 may be adapted and configured to straighten a flow of the propellant gases flowing though the diffuser plate. The propellant gases exiting the turbine are rotationally biased by virtue of the rotation of the turbine blades 42. But by providing the diffuser plate 34 to straighten the flow of the propellant gases post-turbine, the diffuser plate may minimize any negative effect on the trajectory of the rounds exiting the barrel of the gun and tends to reduce any undesirable motion of the gun during recoil. Additionally, or in the alternative, the outlet openings may be formed on the sides and/or back of the diffuser to allow the propellant gases to be directed laterally away and/or rearward in a manner to assist in reducing recoil for the firearm and the operator, or on any mount for hard mounted weapons. In that regard, the outlet openings 44 may be channels formed in the diffuser plate that allow the propellant gases to exit from an outer diameter surface of the diffuser plate or a rear face of the diffuser plate.

The compressor assembly 36 may be operatively connected to the shaft 28 and disposed between the first end of the shaft 28*a* and the second end of the shaft 28*b*. The compressor assembly 36 may have a plurality of compressor blades 48, which are adapted and configured to rotate relative to the shaft 28. The plurality of compressor blades may comprise a first set of blades 48*a* with a first pitch and a second set of blades 48*b* having a second pitch. The first pitch may be different than the second pitch. The differently pitched blades may be arranged to optimize performance of the compressor 36 and provide for multi-stage compression drawing the cooling media into the cooling device 20. The compressor assembly 36 may comprise a compressor bearing 66. The compressor bearing 66 may include an inner race that is operatively fixed to the shaft 28 and an outer race operatively connected to a hub on which the blades 48 of the compressor assembly 36 are mounted. The blades 48 of the compressor assembly 36 may extend upstream of the bearing 66 toward the second end 28*b* of the shaft 28 to maximize space for the compressor blades in the muzzle assembly 22. The inner race and/or outer race of the compressor bearing 66 may include one or more flinger structures configured to prevent the ingress of debris into the bearing. The flinger structure may also provide circulation of the cooling media around the compressor assembly 36, and in particular, the bearing for cooling the bearing. Cooling fins may be provided on the compressor bearing 66 or the compressor assembly 36 for additional cooling. In this way, the compressor assembly 36 may be adapted and configured to allow the cooling media (not shown) to cool the compressor bearing 66. The bearing 66 may be contained in a housing. Rotation elements of the bearing 66 may be lubricated. Lubrication may include grease. Lubrication may include oil from sump located in the housing that is circulated via a pumping member driven from rotation of the outer race.

The rotary drive tube 38 may be operatively connected to a radially outward region of at least one of the plurality of turbine blades 42 and a radially outward region of at least one of the plurality of compressor blades 48. Thus the rotary drive tube acts as a drive connection between the compressor assembly and the turbine assembly. A majority of the turbine blades 42, or all of the turbine blades, may be connected to the rotary drive tube 38. Likewise, a majority of the compressor blades 48, or all of the compressor blades, may be connected to the rotary drive tube 38. In that regard, a majority of the first and/or second stage compressor blades 48*a*,48*b*, or all of the first and/or second stage compressor blades, may be connected to the rotary drive tube 38. The radially outward region of the compressor blade and turbine blade may include the outer tips of the blades. The outer diameter tip(s) of the respective turbine blade(s) 42 and compressor blade(s) 48 may be connected to an inner surface of the rotary drive tube 38. The inner surface of the rotary drive tube 38 may include a locator surface or groove structure to receive the respective outer diameter tip(s) of the respective turbine blade(s) and compressor blade(s). The connection between the rotary drive tube 38 and the respective compressor blade 48 and/or turbine blade 42 may be via a mechanical fastener, mechanical interlock, dimensional interference, thermal interference (e.g., heat or cool shrink), and/or via welding or brazing. The rotary drive tube 38 may be adapted and configured to rotate relative to the shaft 28 and rotate with the plurality of turbine blades 42 and the plurality of compressor blades 48. Thus, upon discharge of a round/projectile, the propellant gases expand and are directed downstream to impinge the turbine blades 42, which in turn causes rotation of the turbine blades, rotation of the rotary drive tube 38 and rotation of the compressor blades 48 to draw the cooling media into the cooling device and the muzzle assembly 22. The rotary drive tube 38 may have a plurality of outlet vents 50 downstream of the plurality of compressor blades 48 for allowing the cooling media to flow out of the muzzle assembly. The rotary drive tube 38 may overlap a portion of the diffuser plate 34 with a clearance between the outer diameter surface of the diffuser plate and the rotary drive tube 38 to allow a portion of the effluent from the compressor to flow around the diffuser plate and mix with propellant gases exiting from the turbine and diffuser plate. Depending upon the application, the clearance between the outer diameter surface of the diffuser plate and the rotary drive tube 38 may include a seal. This configuration may induce a venturi like effect, thus "scavenging" flow from the compressor and improving efficiency of the cooling device.

The heat exchanger 24 may be upstream of the muzzle assembly 22 and may be operatively connected therewith adjacent the second end of the shaft 28*b*. The heat exchanger 24 may comprise an intake 52 and a discharge 54 and at least one cooling fin 56. The intake 52 may be adapted and configured to direct a cooling media onto the at least cooling fin 56. The intake 52 may be provided with a filter. The filter assists in keeping internal components cleaner and in better/safer working order, and may assist in reducing the audible sound of the air being drawn into the heat exchanger via the intake. The discharge 54 may be aligned with and adapted and configured to direct the cooling media from the at least one cooling fin 56 over the boss 68 of the second end 28*b* of the shaft 28 to the plurality of compressor blades 48. For example, the heat exchanger may be adapted and configured for passage of ambient air as the cooling media. The heat exchanger 24 may further comprise a chamber 58 defined by an outer shell 60 and a center tube 62. The at least one cooling fin 56 may comprise a plurality of fins 56 extending radially outward from the center tube 62 to the outer shell 60. The at least one cooling fin 56 may or may not connect with the outer shell. Insulation or an air gap may be provided between the outer shell and the at least one cooling fin. The center tube 62 may be adapted and configured to supercircumjacently receive the barrel of the gun (not shown). Preferably, center tube 62 has a contact fit with the gun barrel to provide thermal conduction between the gun barrel and the center tube. The heat exchanger may be formed with a center tube 62 and without an outer shell 60 with the cooling fin(s) projecting outward from the center tube. The heat exchange may be formed with an outer shell 60 and without a center tube 62 with the cooling fin(s) projecting inward from the outer shell and contacting the gun barrel directly. The heat exchanger may comprise a plurality of pieces that may be fitted around the barrel of the gun, for instance, a two piece clam shell arrangement or multiple two piece clam shell arrangements for irregularly shaped or tapered barrels.

The shield 26 may be operatively and repositionally connected to the muzzle assembly 22. As mentioned above the shield 26 may connect to one or more struts 72 extending between the boss extension 70 of the second end 28*b* of the shaft 28 and the diffuser plate 34. The shield 26 may be radially outward of the rotary drive tube 38 and may be adapted and configured to selectively directionally deflect effluent from the outlet vents 50 of the rotary drive tube away from the muzzle assembly 22. The shield 26 may have deflecting surfaces shaped to direct at least a portion of the flow of the cooling media from the outlet vents 50 of the rotary drive tube 38 around a portion of the diffuser plate 34. In such a configuration, the deflecting surfaces of the shield 26 allows the flow of the cooling media to be straightened, similar to the flow of the propellant gases, to minimize any negative effect on the trajectory of the rounds exiting the barrel of the gun. Additionally, this allows the cooling media to intermix with the flow of the propellant gases and thereby disperse the propellant gases (improving the visibility for a user of the gun during continued use of the gun and minimizing the visibility of the propellant gases that might be used for locating the gun. The cooling media also reduces the temperature of the propellant gases as it intermixes with the propellant gases, thereby reducing visibility in the infrared spectrum as well as from the flash from the muzzle opening upon firing of the gun.

Figure 2:
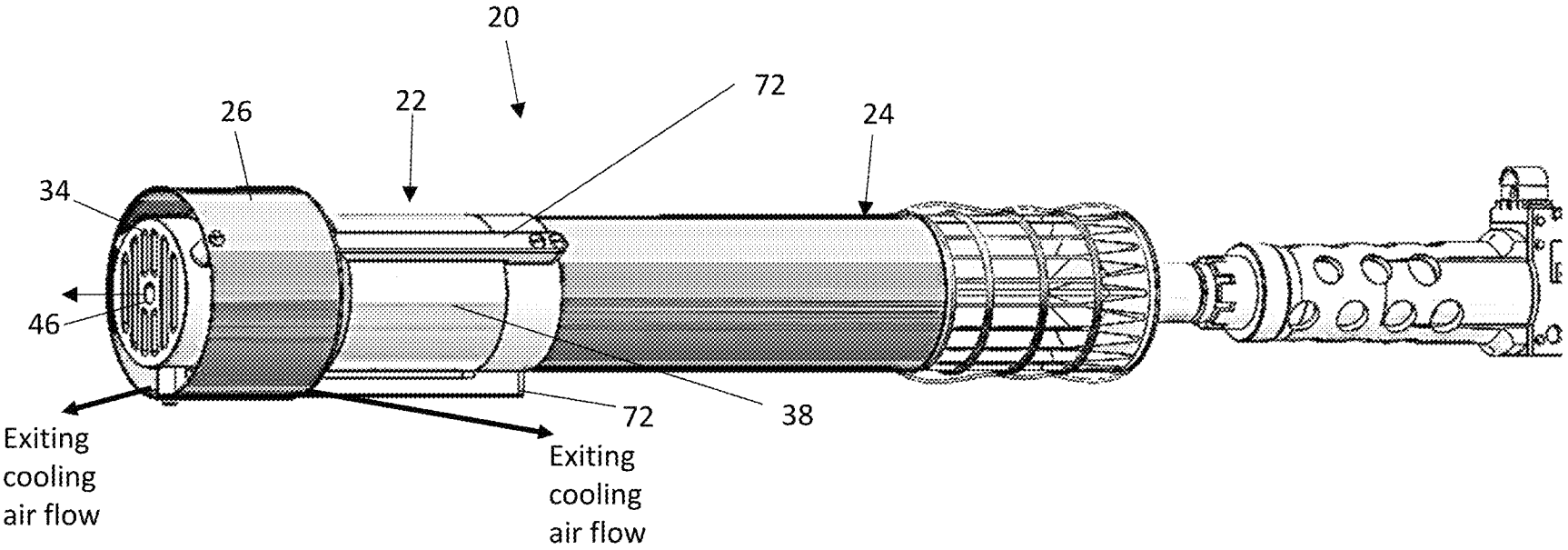
FIG. 2 is a perspective view of the gun barrel cooling device installed on a gun with the shield oriented to direct effluent cooling media downward and toward the upstream end of the cooling device, for instance, in an aircraft gun application.
Figure 3:
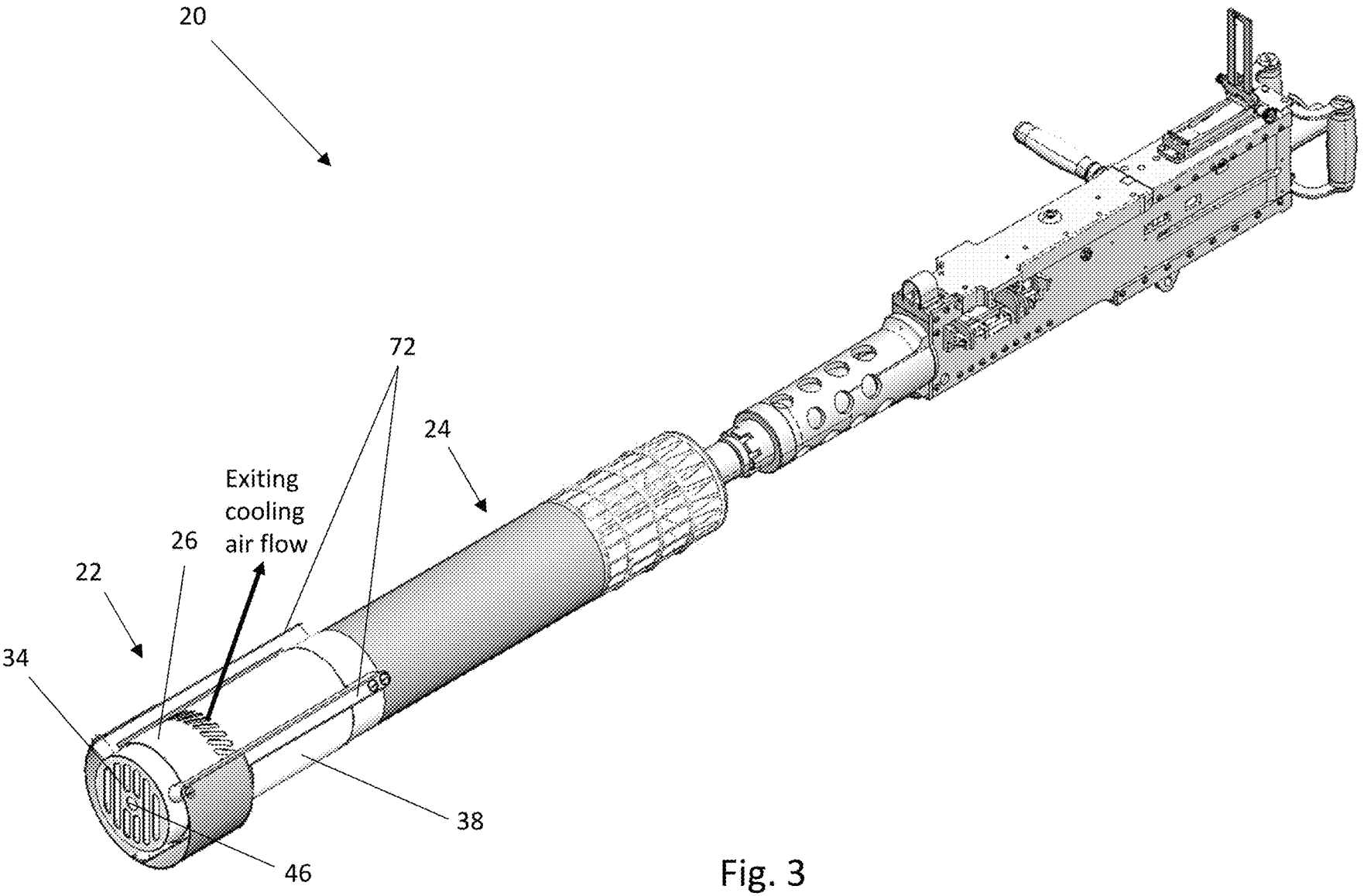
FIG. 3 is a perspective view of the gun barrel cooling device installed on a gun with the shield oriented to direct effluent cooling media upward and toward the downstream end of the cooling device, for instance, in a ground or land based gun application.
Figure 4:
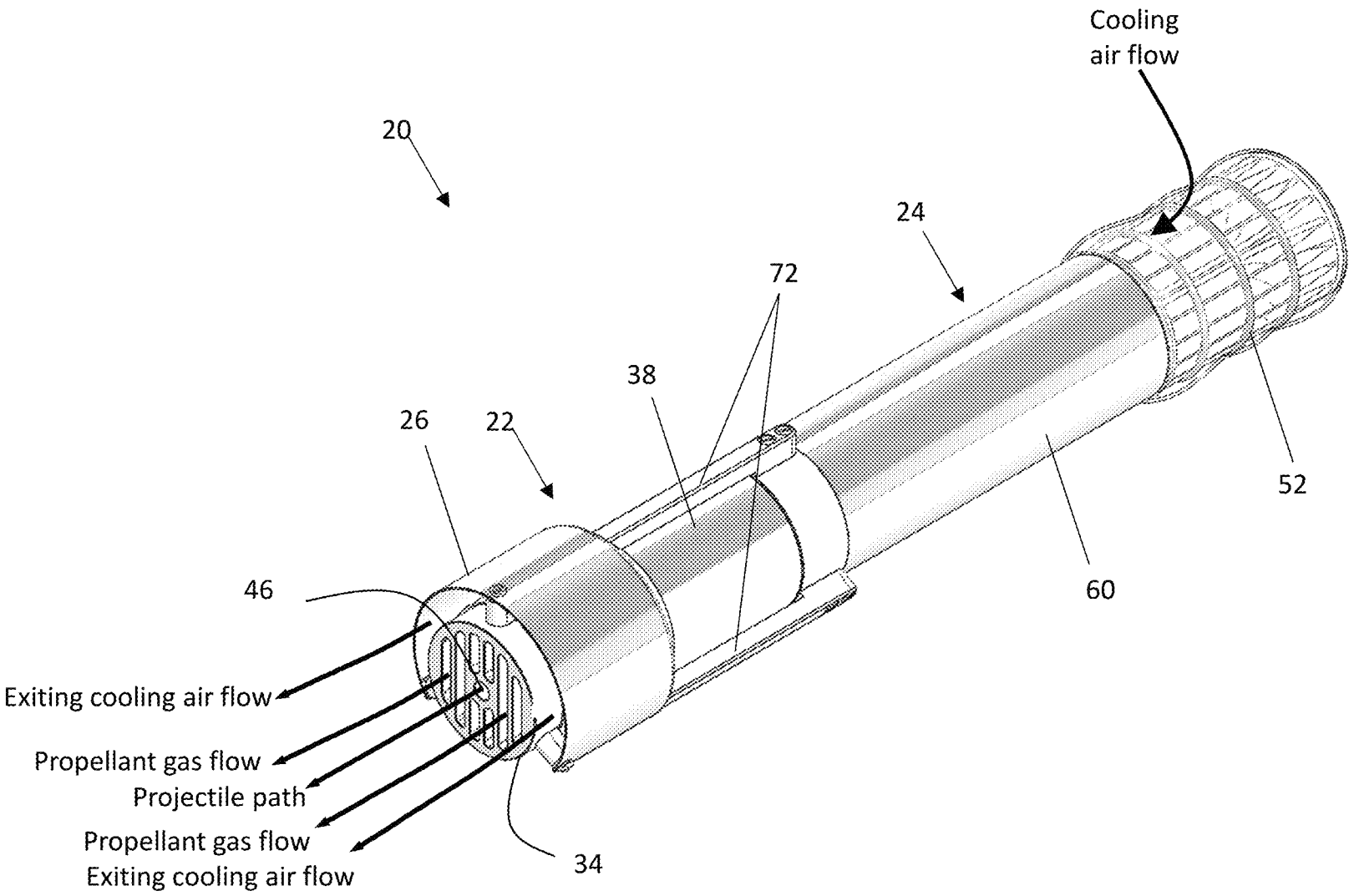
FIG. 4 is a perspective view of the gun barrel cooling device.
Figure 5:
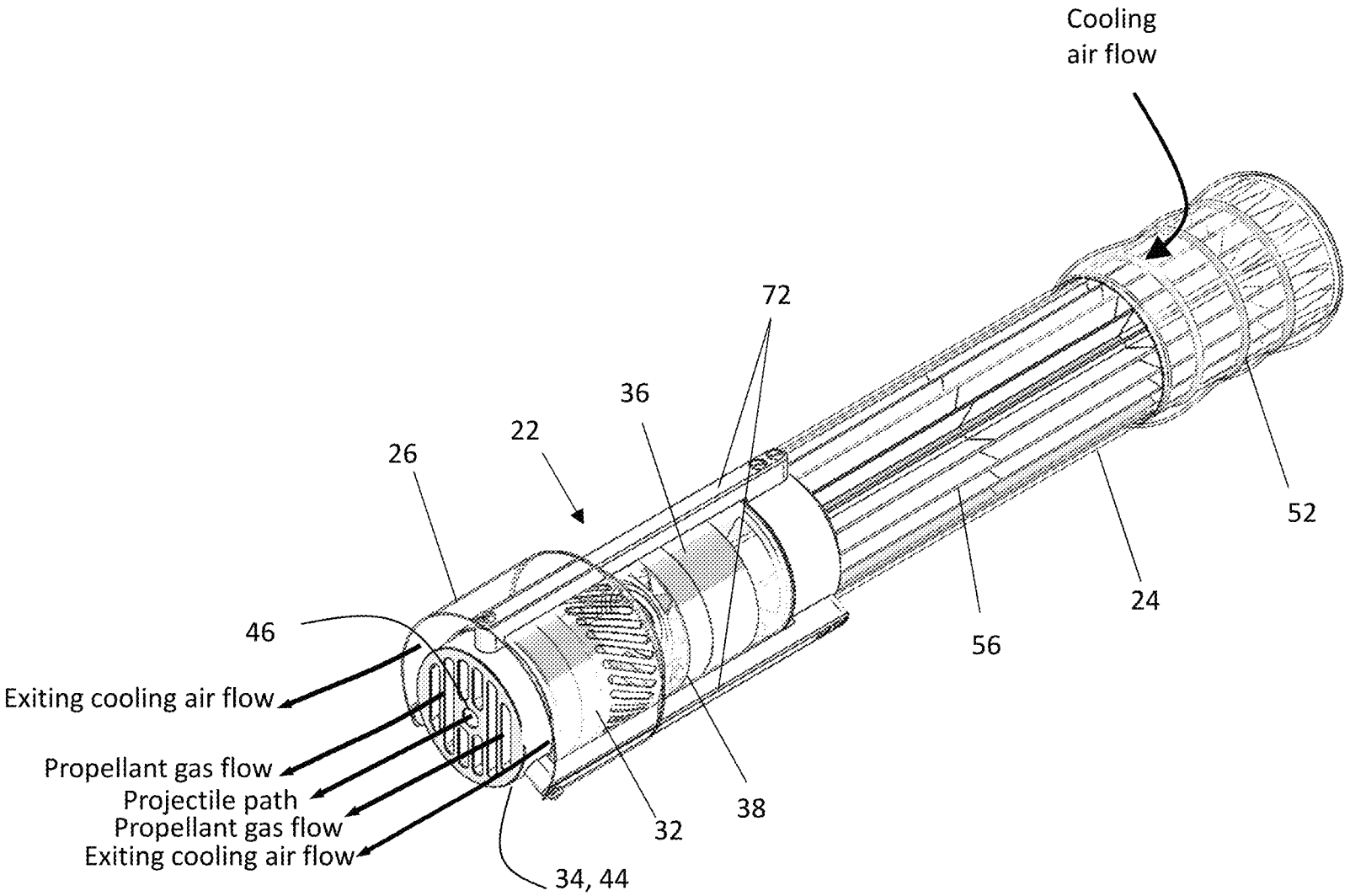
FIG. 5 is a perspective view of the gun barrel cooling device with certain internal elements shown in phantom.
Figure 6:
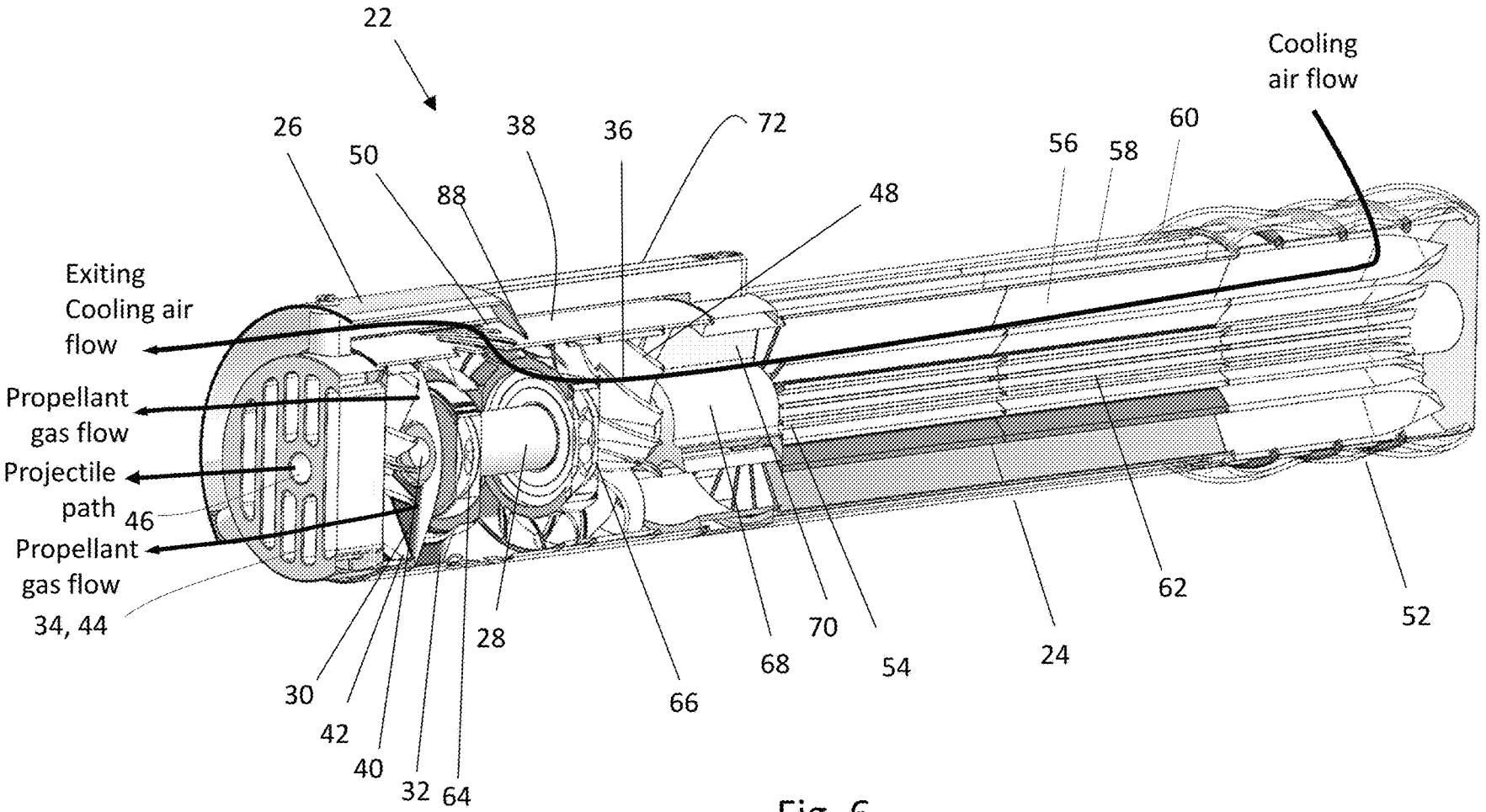
FIG. 6 is a cross-sectional perspective view of the gun barrel cooling device.
Figure 7:
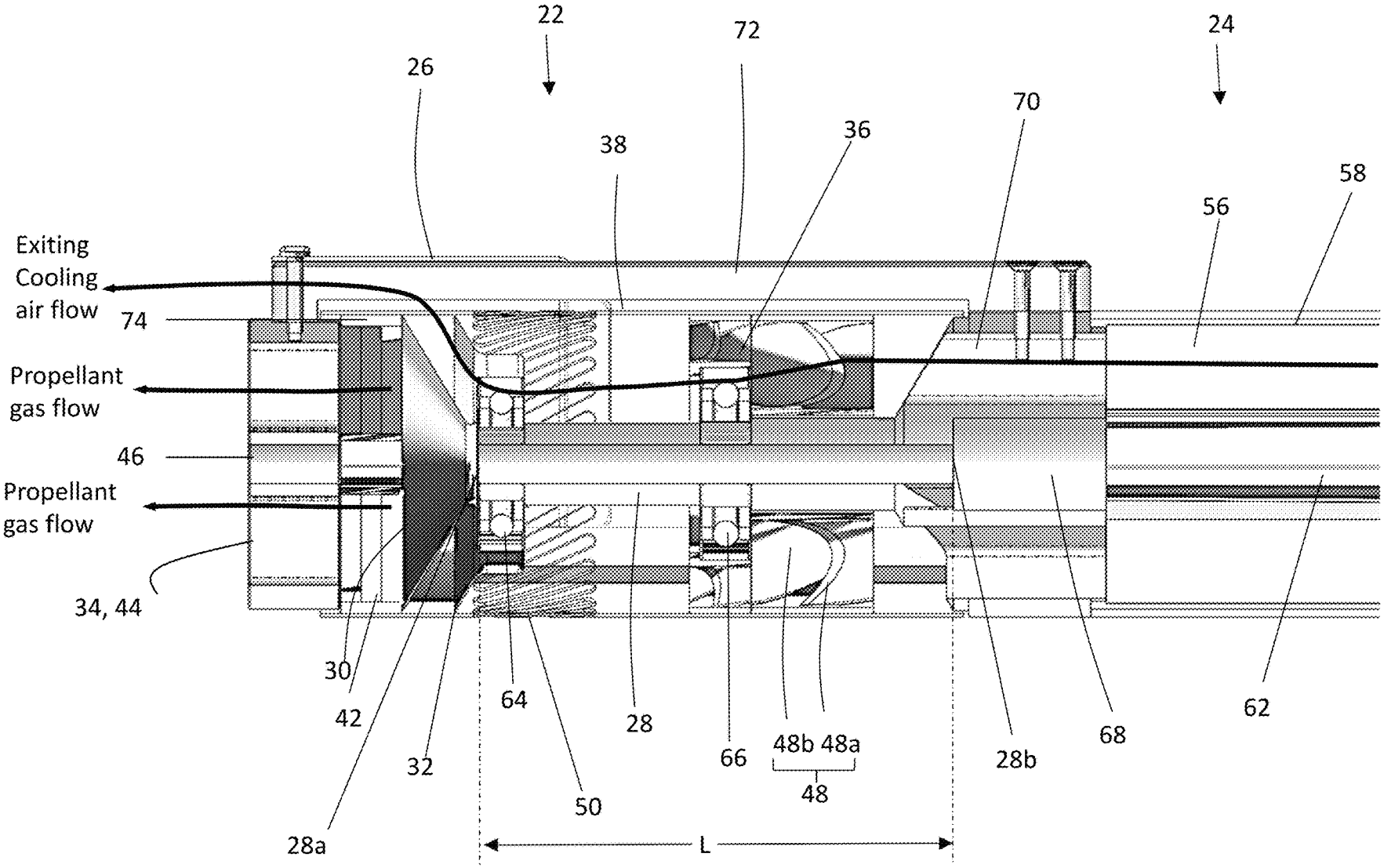
FIG. 7 is a cross-sectional side view of the gun barrel cooling device.
Figure 8:
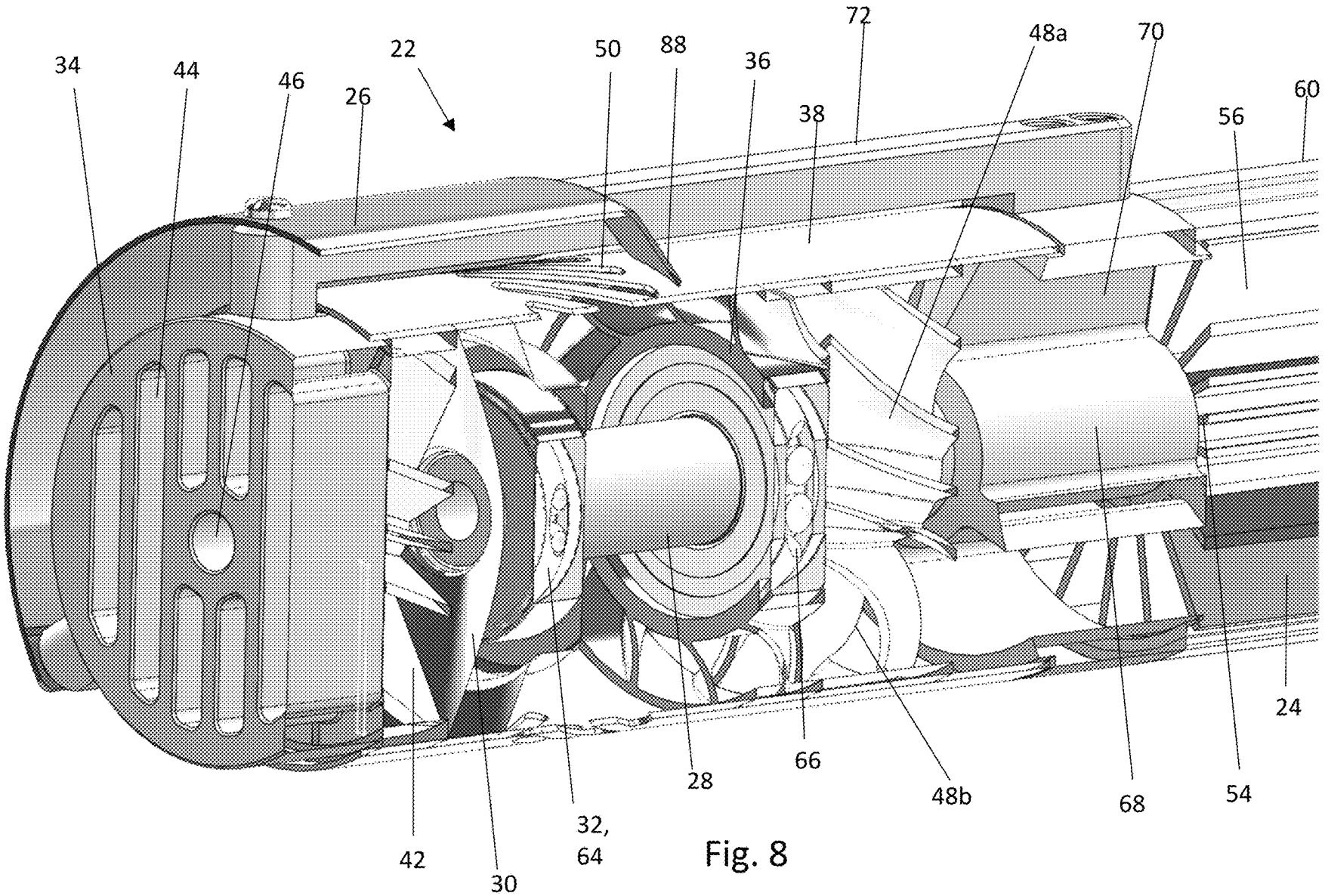
FIG. 8 is another cross-sectional perspective view of the gun barrel cooling device.

Depending upon the application, the shield 26 may be selectively repositioned relative to the muzzle assembly 22 as desired to direct effluent from the outlet vents 55 in any direction or combination of directions. For instance, in a ground application as shown in FIG. 3, the shield 26 may be positioned on the muzzle assembly 22 so that the cooling media exiting the outlet vents 50 are deflected upward by the shield with a portion of the cooling media flowing around and downstream of the diffuser plate 34 as explained above. The shield may be provided with a deflecting tab 88 to direct flow around the diffuser plate 34. This would minimize dust, dirt and other ground level material from being impacted by the velocity of the exiting cooling media. As another example, in a helicopter application with a bottom mounted gun, the shield 26 may be positioned on the muzzle assembly so that the cooling media exiting the outlet vents 50 are deflected downward by the shield. This would allow the exiting cooling media to be directed away from the helicopter. As another example, in an airplane application, the shield 26 may be positioned on the muzzle assembly so that the cooling media exiting the outlet vents 50 are deflected rearward or both forward and rearward as shown in FIG. 2. As may be desired, in aircraft applications, the shield may be provided with deflecting surfaces (not shown) shaped to direct at least a portion of the flow of the cooling media from the outlet vents 50 of the rotary drive tube 38 in a direction away from the diffuser plate 34, for instance, an upstream or rearward direction, or as shown in FIG. 2 both rearward and forward. Such configurations would prevent any air currents generated by the motion of the aircraft and propellant gases from interfering with the flow of the cooling media exiting the muzzle assembly 22. Such configurations would tend to prevent backpressure on the system from the aircraft's slipstream. Also, such configurations may induce a venturi like effect, thus "scavenging" flow from the outlet vents of the rotary tube and improving efficiency of the cooling device. Such configurations may also be desirable in ground or naval applications where there is a strong wind.

Figure 9:
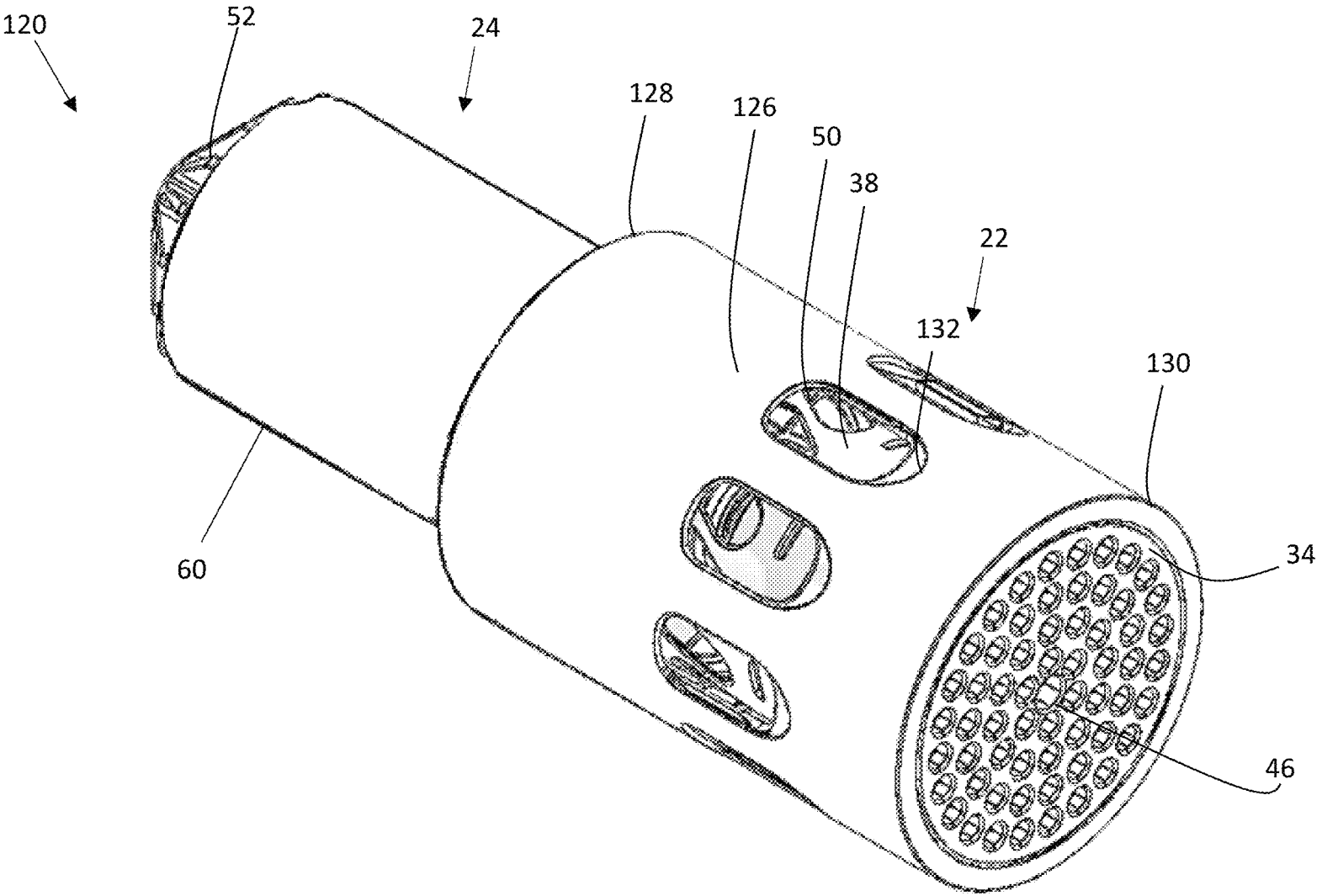
FIG. 9 is a perspective view of another embodiment of the gun barrel cooling device.
Figure 10:
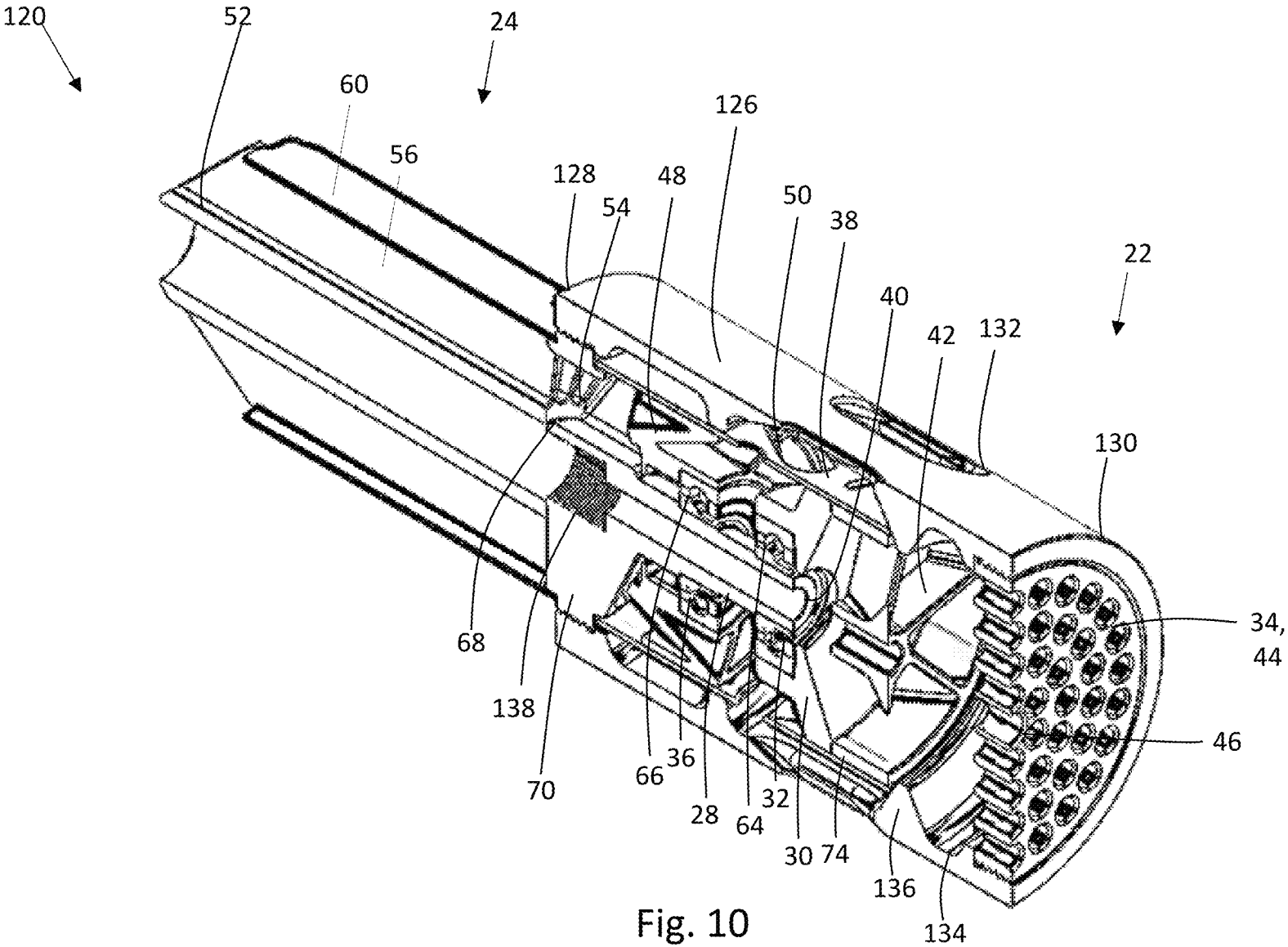
FIG. 10 is a perspective cross sectional view of the gun barrel cooling device of FIG. 9.
Figure 11:
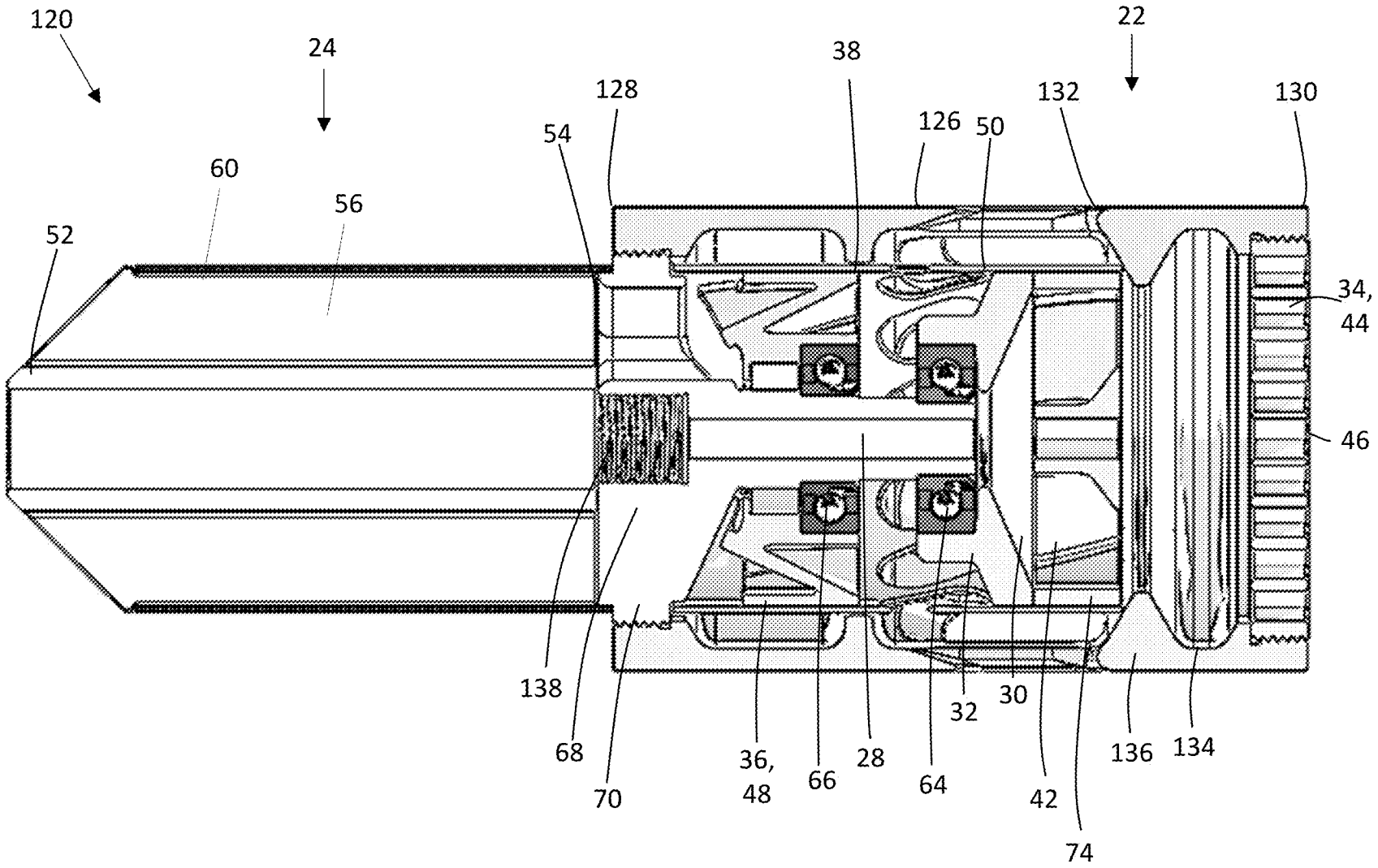
FIG. 11 is a side cross sectional view of the gun barrel cooling device of FIG. 9.

FIGS. 9-11 show another embodiment of the gun barrel cooling device 120. In many respects, the gun barrel cooling device 120 of FIGS. 9-11 is similar to that shown in FIGS. 1-8 and described previously. Accordingly, like parts have been numbered similarly and for the sake of brevity will not be discussed unless their cooperative relationship with certain elements is different from that previously discussed. In the embodiment of FIGS. 9-11, a diffuser tube 126 extends around the muzzle assembly 22, thus replacing the shield 26 and dispensing with the need for the struts 72 and their mechanical fastener connections to the shield. The diffuser tube 126 includes internal threading at its proximal and distal ends 128,130. At the proximal end 128, the diffuser tube 126 threadably connects with the boss extensions 70, and at the distal end 130, the diffuser tube threadably connects with the diffuser plate 34. Thus, the diffuser tube 126 may be removed and installed over the muzzle assembly 22 with the threading on the proximal end 128. The diffuser tube 126 may include vent holes 132 to allow exiting cooling air flow from the outlet vents 50 of the rotary drive tube 38 to exit the muzzle assembly 22. The diffuser tube 126 may also include an enlarged diameter region 134 downstream of the cup shaped body 74 of the turbine assembly 32 to allow the propellant gas to expand slightly before being discharged from the diffuser plate 34. The diffuser tube 126 may have a tapered shoulder 136 projecting inward toward the cup shaped body 74 of the turbine assembly to form a transition for the propellant gases as they move from the end of the cup shaped body 74 of the turbine assembly to the enlarged diameter region 134. Depending upon the desired application, the tapered shoulder 136 may be located at a small axial distance from the end of the cup shaped body 74 to form a gap. The gap may allow a portion of the exiting cooling air flow from the vent outlets 50 of the rotary drive tube 38 to pass along the tapered shoulder 136 and mix with the propellant gases in the enlarged diameter region 134 before being discharged through the diffuser plate 34. In the embodiment of FIGS. 9-11, a seal is formed between the tapered shoulder 136 and the end of the cup shaped body 74 of the turbine assembly 32. Additionally, in the embodiment of FIGS. 9-11, the shaft 28 has threading 138 to allow coupling of the muzzle assembly 22 to the gun barrel.

Figure 12:
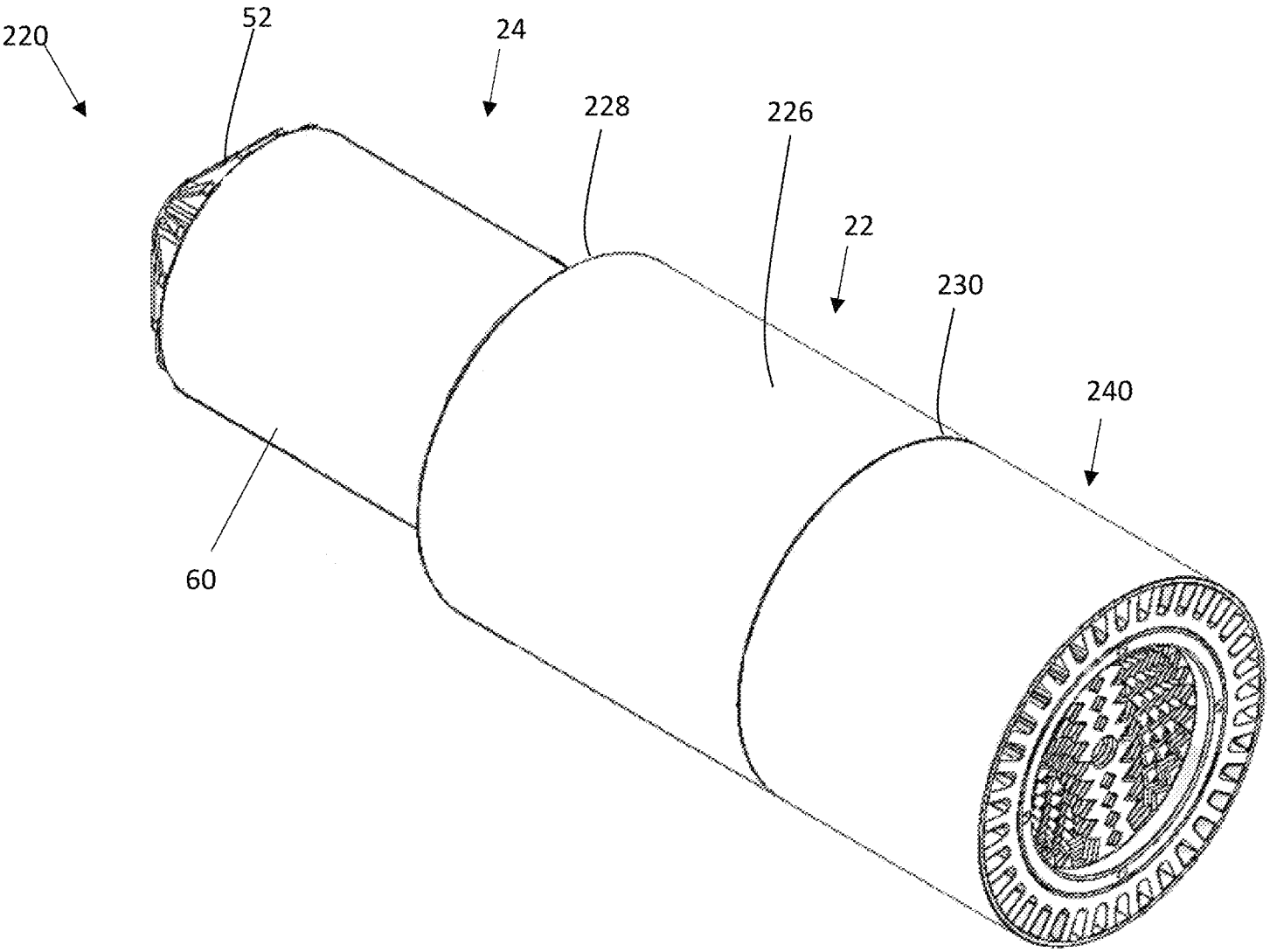
FIG. 12 is a perspective view of another embodiment of the gun barrel cooling device.
Figure 13:
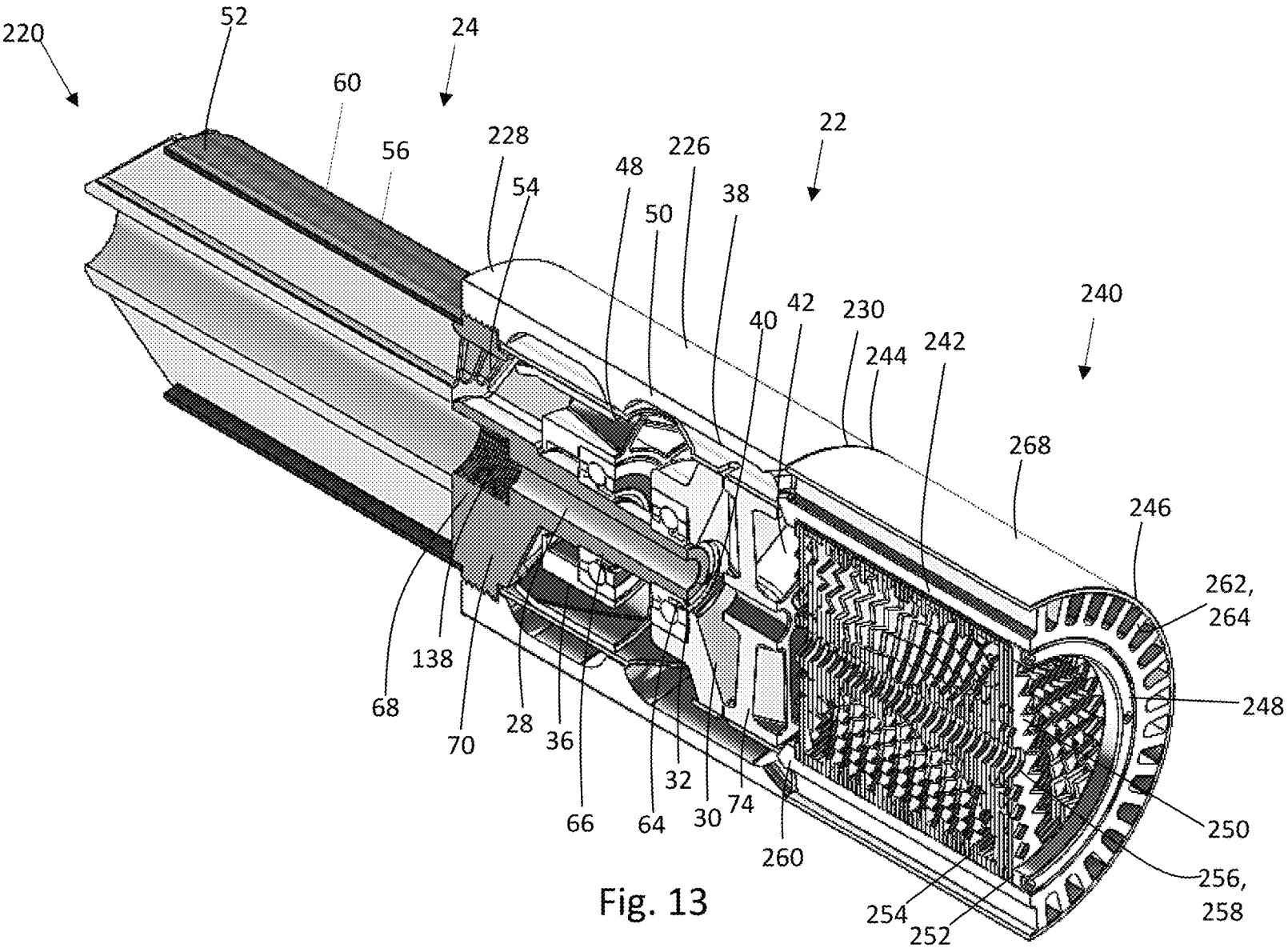
FIG. 13 is a perspective cross sectional view of the of the gun barrel cooling device of FIG. 12.
Figure 14:
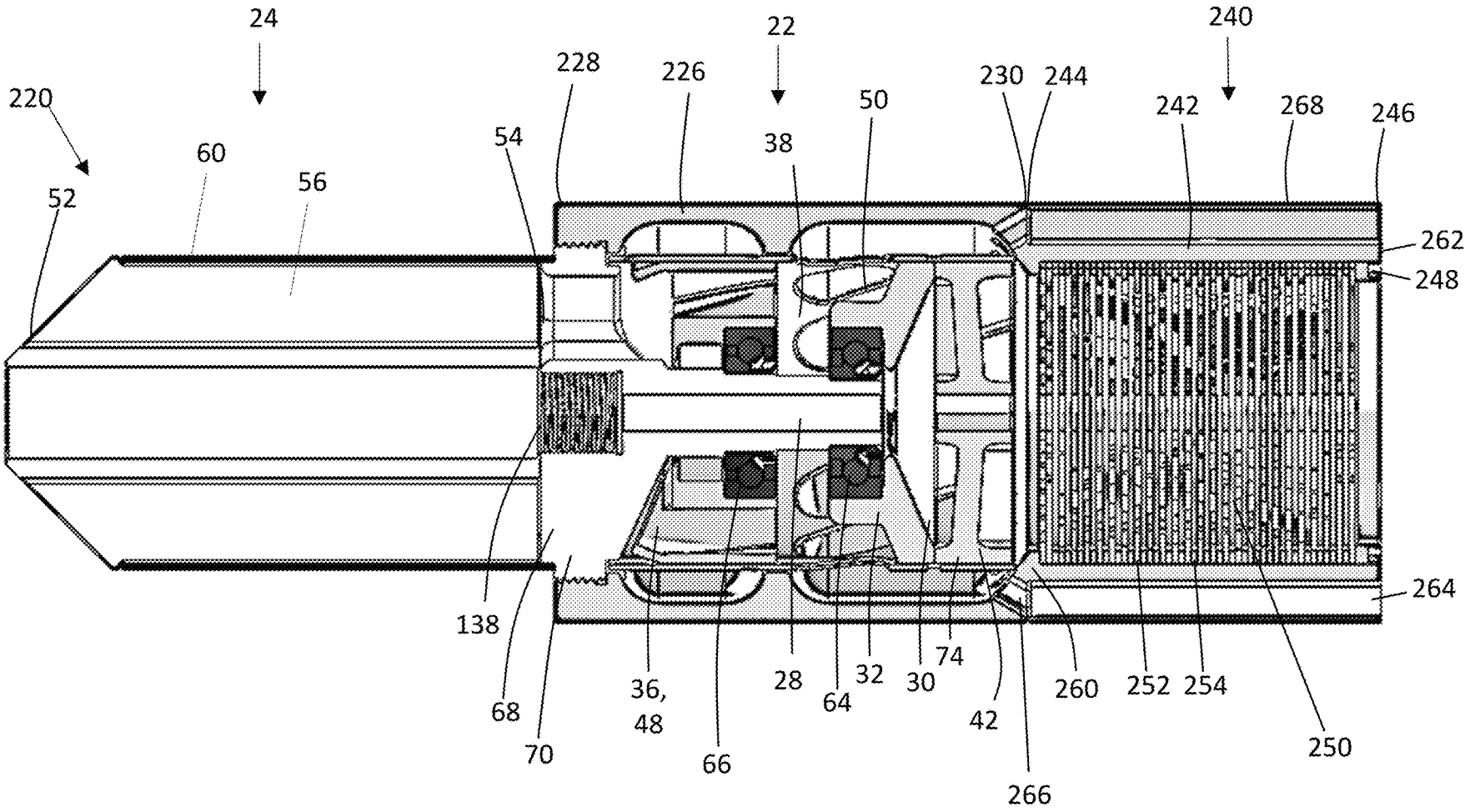
FIG. 14 is a side cross sectional view of the gun barrel cooling device of FIG. 12.
Figure 15:
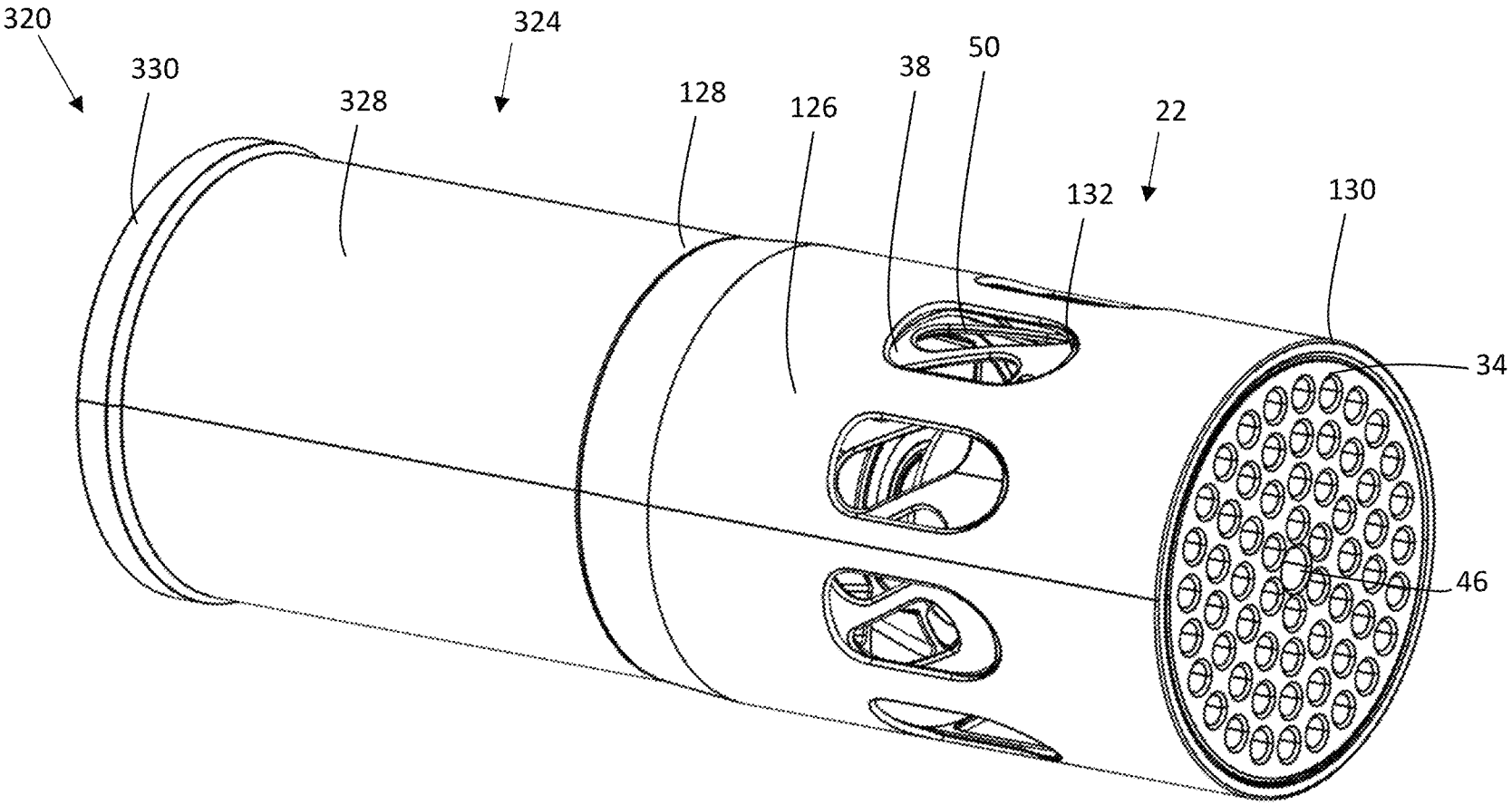
FIG. 15 is a perspective view of another embodiment of the gun barrel cooling device.
Figure 16:
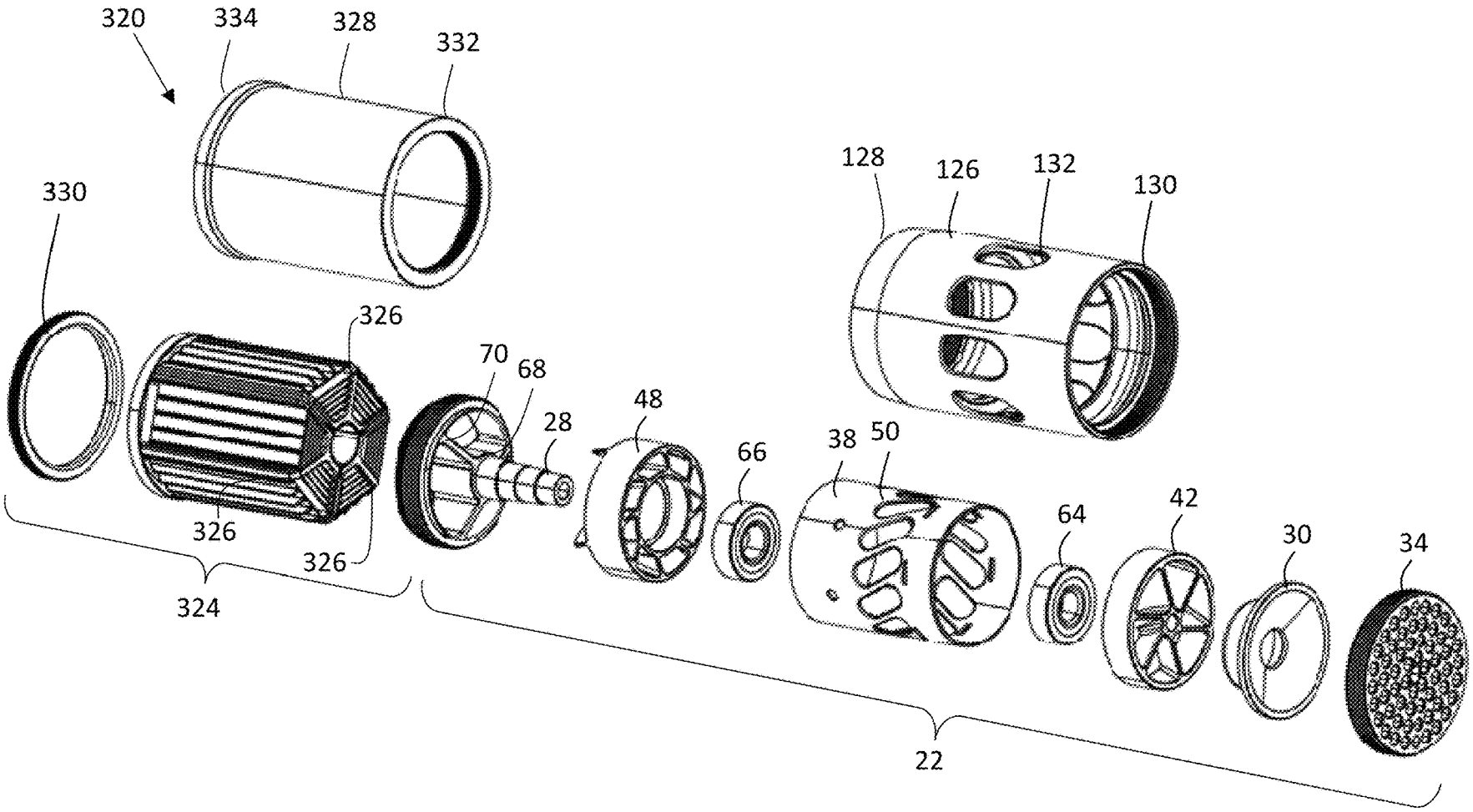
FIG. 16 is an exploded, perspective view of the embodiment of the gun barrel cooling device of FIG. 15.
Figure 17:
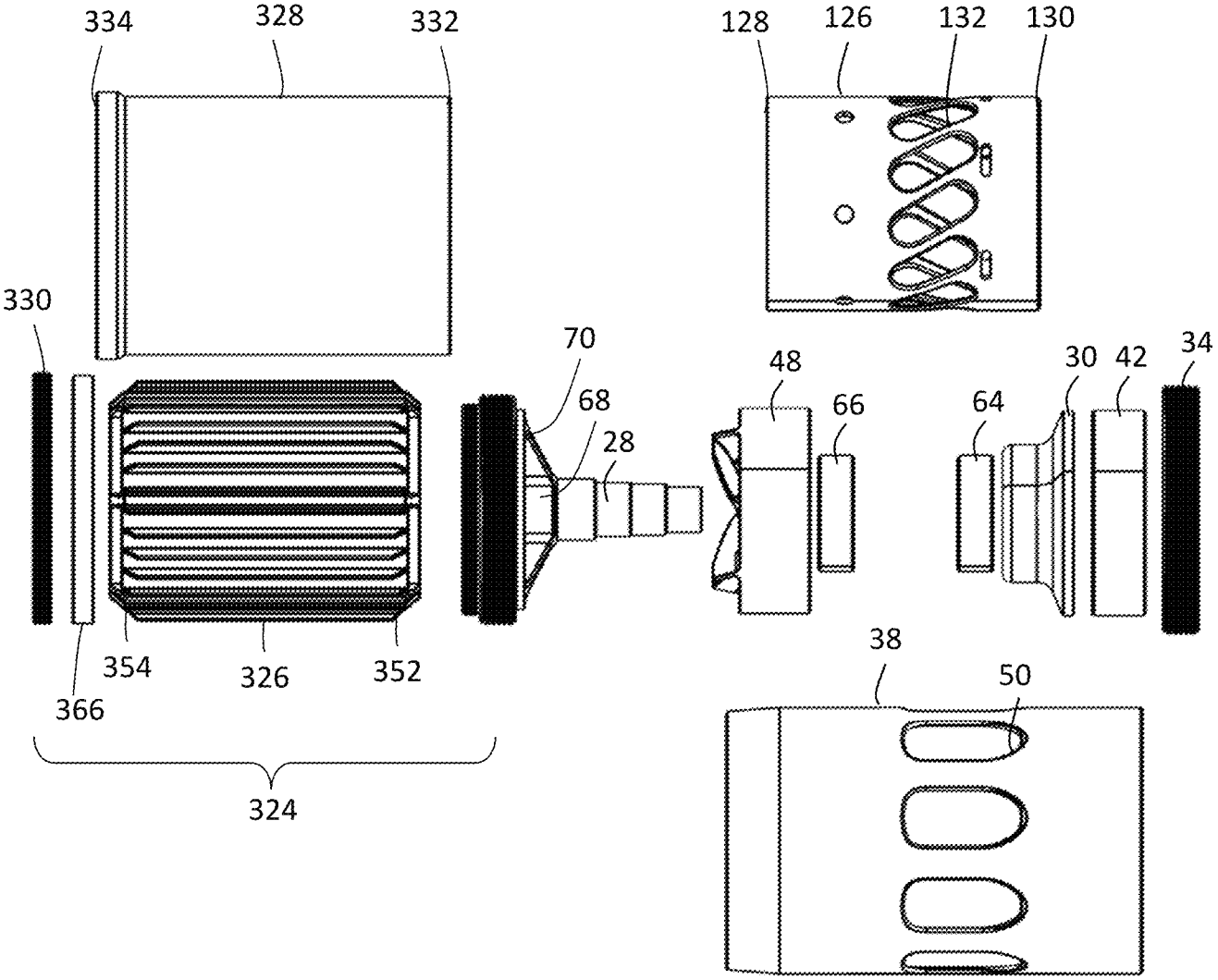
FIG. 17 is an exploded side elevation view of the embodiment of the gun barrel cooling device of FIG. 15.

FIGS. 12-14 show another embodiment of the gun barrel cooling device 220. In many respects, the gun barrel cooling device of FIGS. 12-14 is similar to that shown in FIGS. 1-8, and that shown in FIGS. 9-11, and described previously. Accordingly, like parts have been numbered similarly and for the sake of brevity will not be discussed unless their cooperative relationship with certain elements is different from that previously discussed. In the embodiment of FIGS. 12-14, a cylindrical shell 226 extends around the muzzle assembly 22, thus replacing the diffuser tube of the embodiment of FIGS. 9-11. In the drawings, the cylindrical shell 226 includes internal threading at its proximal and distal ends 228,230. At the proximal end 228, the cylindrical shell 226 threadably connects with cooperative threading on the boss extensions 70. At the distal end 230, the cylindrical shell 226 threadably connects with a suppressor portion 240. In the alternative, weld connections may also be provided at the proximal and/or distal ends to connect the cylindrical shell 226 with the boss extensions 70 and/or the suppressor portion.

The suppressor portion 240 includes a main body 242 with first and second ends 244,246. The first end 244 of the main body 242 has outward facing threading that cooperates with the threading on the distal end 230 of the cylindrical shell 226 to allow the suppressor portion 240 to be removably connected downstream of the turbine assembly 32. The outward facing threading of the first end 242 of the main 240 body may be angled to match the threading on the distal end 230 of the cylindrical shell 226. The second end 246 of the main body 242 may have internal threading for a locking nut 248 to secure a blade stack 250 in the bore of the main body 242.

The blade stack 250 may include a plurality of serrated blades 252 and ring shaped spacers 254. The ring shaped spacers 254 may be disposed between adjacent serrated blades 252 in an alternating pattern. Each of the serrated blades 252 and ring shaped spacers may include an annular periphery that is dimensioned to fit within the bore of the main body 242. The serrated blades 252 may have a radially inward facing region with serrations and a bridging portion 256 extending across the center of the serrated blades 252. Outer edges of the bridging portion 256 may include serrations and the bridging portion may include a center hole 258. Cumulatively, the center holes of the serrated blades 252 may form a central passage through which the round/projectile passes. Each serrated blade 252 in the blade stack may be angularly offset about its center hole 258 from an adjacent blade from the first end of the bore of the main body to the opposite second end of the bore of the main body. The locking ring 248 may have outward facing threading that cooperates with the inward facing threading at the second end 246 of the main body 242 to secure the blade stack 250 in the bore of the main body. The main body 242 may include an internal shoulder 260 downstream and adjacent to the first end 244 of the main body. The blade stack 250 may be secured in the bore of the main body 242 between the locking ring 248 and the internal shoulder 260. The serrated blades 252 and ring shaped spacers 254 may include locator features to allow the serrated blades to maintain a set angular offset arrangement during assembly into the bore of the main body. For instance, the serrated blades 252 may have tabs on their annular periphery that locate in one or more helical grooves in the bore of the mail body 242. Cumulatively, the serrations of the serrated blades 252 form baffles in the interior of the main body 242 that diffuse the propellant gases to reduce noise and muzzle flash from discharge.

To provide cooling for the suppressor portion 240, the main body 242 may include outward projecting radial fins 262 that are angularly spaced about the outer surface of the main body and that extend from the first end 244 of the main body to the second end 246 of the main body. The fins 262 define axially extending cooling channels 264 between the fins. At the first end 244 of the main body, each channel 264 is arranged to receive the exiting cooling flow from the outlet vents 50 of the rotary drive tube 38. The cylindrical shell 226 is formed in a manner to direct exiting cooling air flow from the outlet vents 50 of the rotary drive tube 38 to the cooling channels 264. A plurality of ports 266 may be formed in the first end 244 of the main body through which the exiting cooling flow from the outlet vents 50 may flow into the cooling channels 264. A cover 268 may extend around the outer edges of the radial fins 262 to further define the channels 264 and further contain the exiting cooling flow in the channels to be discharged adjacent the second end 246 of the main body 242.

FIGS. 15-19 show a further embodiment of the gun barrel cooling device 320. In many respects, the gun barrel cooling device of FIGS. 15-19 is similar to that shown in FIGS. 1-8 and FIGS. 9-11, and described previously. Accordingly, like parts have been numbered similarly and for the sake of brevity will not be discussed unless their cooperative relationship with certain elements is different from that previously discussed. In the embodiment of the gun barrel cooling device of FIGS. 15-19, the heat exchanger 324 is structured differently relative to the embodiments of FIGS. 1-8 and FIGS. 9-11. In the embodiments of FIGS. 1-8 and FIGS. 9-11, the heat exchanger 24 included the center tube 62 that was adapted and configured to supercircumjacently receive the barrel of the gun. For instance, in the embodiments of FIGS. 1-8 and FIGS. 9-11, the heat exchanger 24 includes the center tube 62 that is formed with a bore that slip fits onto the barrel of the gun. In the embodiment of FIGS. 15-19, the heat exchanger 324 includes a plurality of fin segments 326, an outer shell 328, and a collet nut 330 that cooperate to move at least one of the plurality of fin segments radially to engage the barrel of the gun. At least one of the fin segments 326 surrounds the gun barrel, and the outer shell 328 surrounds and contains the fin segments with the collet nut 330 holding the fin segments in position within the outer shell. The outer shell 328 may have a first end 332 with inward facing threading that engages outward facing threading on the boss extensions 70 thereby allowing the heat exchanger 324 to be removably connected with the muzzle assembly 22. The outer shell 328 may have a second end 334 with inward facing threading that cooperates with outward facing threading on the collet nut 330. At least one and preferably each of the fin segments 326 has first and second tapered outer ends 352,354. The first tapered outer end 352 of the fin segments 326 may cooperate with a cooperating tapered shoulder 362 formed on the inner surface of the outer shell 328 adjacent to and axially inward of the inward facing threading on the first end 332 of the outer shell. The second tapered outer ends 354 of the fin segments 326 may cooperate with a cooperating tapered shoulder 364 formed on an inner surface of a collet ring 366 that is arranged axially inward of the collet nut 334. When the collet nut 334 is tightened against the collet ring 366, at least one and preferably each of the fin segments 364 moves radially inward within the outer shell 328 into engagement with the gun barrel as the first tapered outer ends 352 of the fin segments 326 slide on the cooperating tapered shoulder 362 on the inner surface of the outer shell 328 and the second tapered outer ends 354 of the fin segments 326 slide on the cooperating tapered shoulder 362 of the collet ring 366. The interior surfaces 368 of the fin segments 326 that engage the barrel may be formed with a heat conductive material, for instance, copper laminates, for enhanced thermal conductivity.

Figure 18:
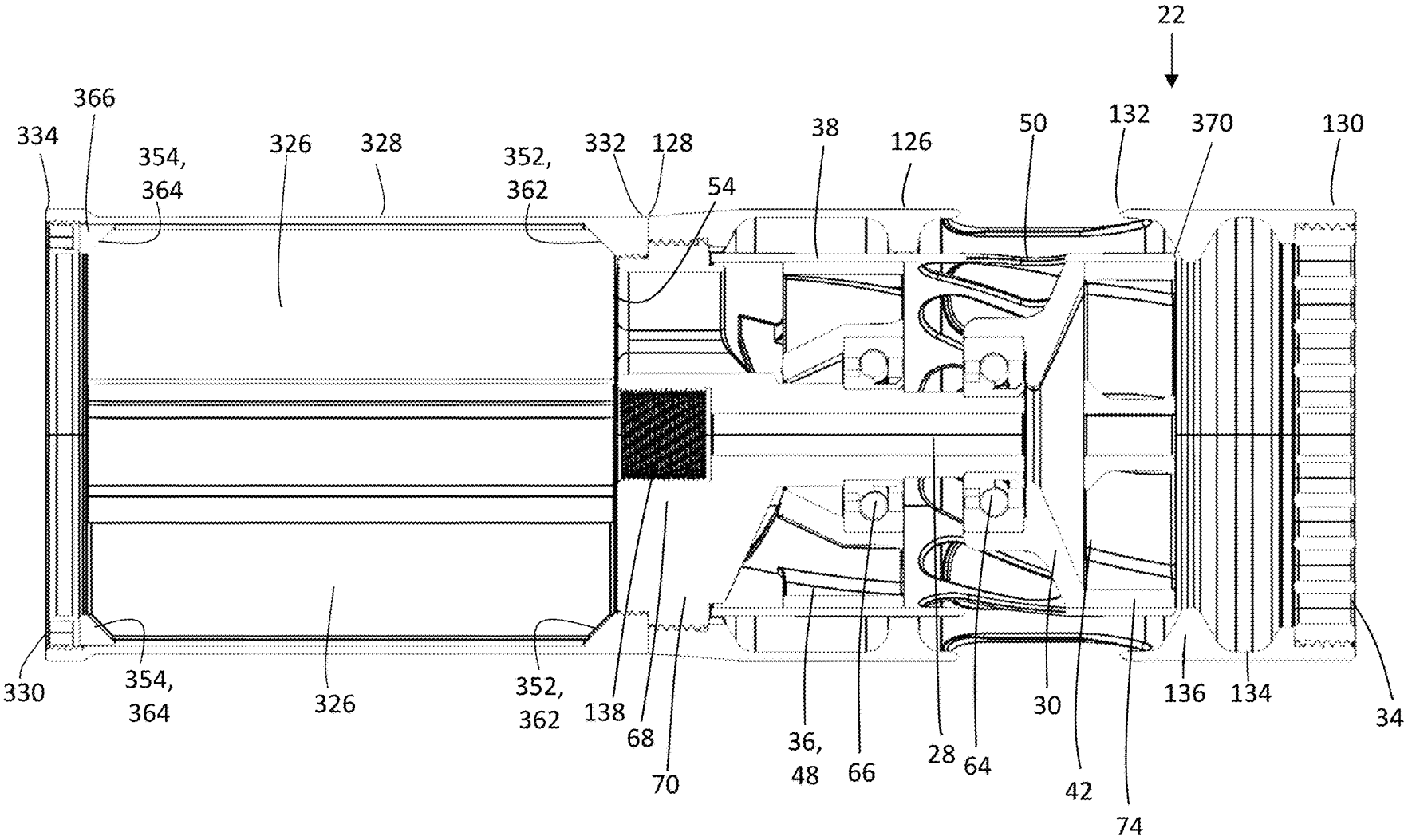
FIG. 18 is side cross sectional view of the embodiment of the gun barrel cooling device of FIG. 15.
Figure 19:
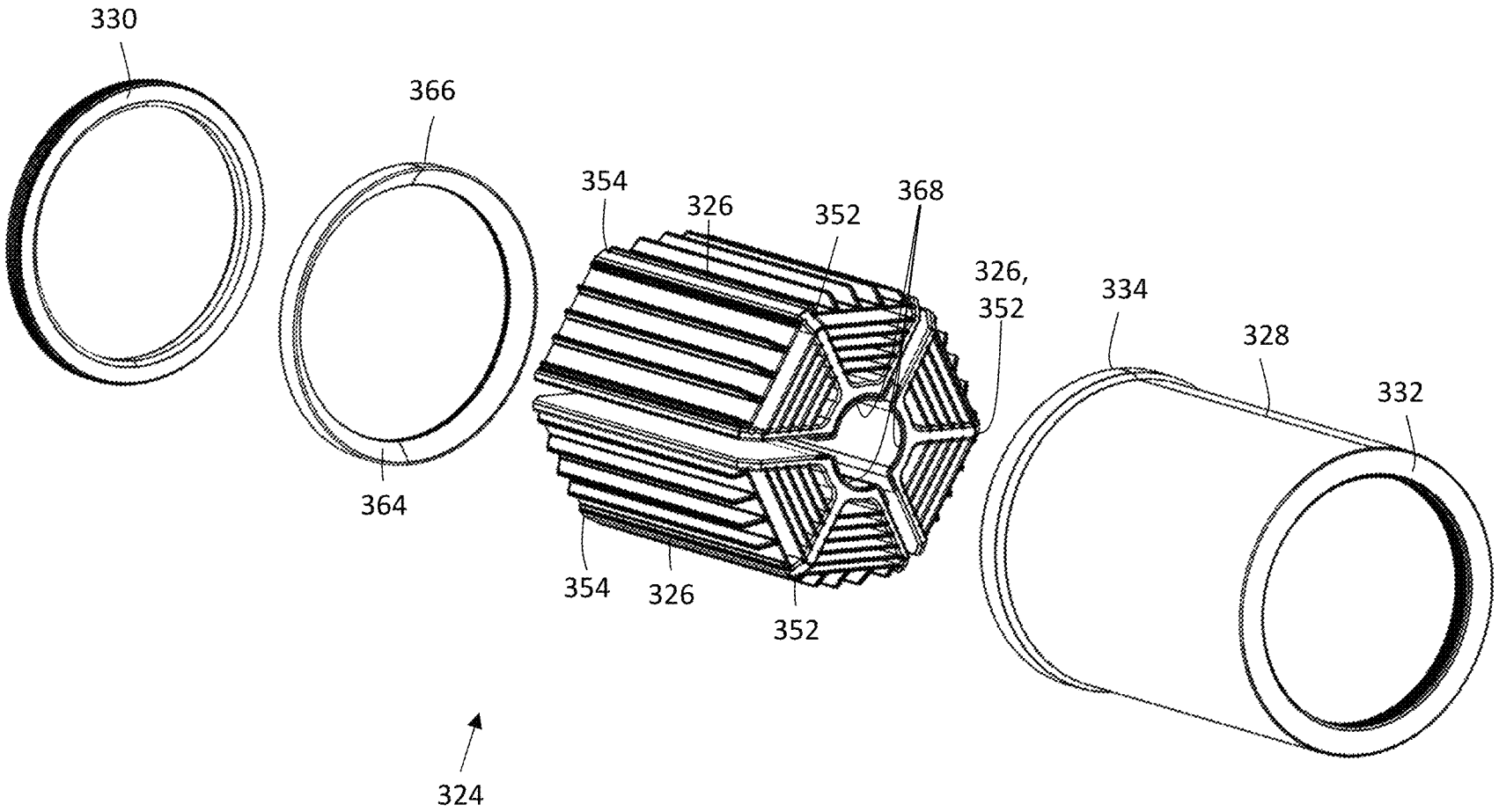
FIG. 19 is a perspective exploded view of an embodiment of a heat exchanger of the embodiment of the gun barrel cooling device of FIG. 15.

Also, in the embodiment of the gun barrel cooling device of FIGS. 15-19, the diffuser tube 126 includes the enlarged diameter region downstream 134 of the cup shaped body 74 of the turbine assembly 32 to allow the propellant gas to expand slightly before being discharged from the diffuser plate 34. The diffuser tube 126 has a tapered shoulder 135 projecting inward toward the cup shaped body 74 of the turbine assembly 32 to form a transition for the propellant gases as they move from the end of the cup shaped body 74 of the turbine assembly to the enlarged diameter region 134. As best shown in FIG. 18, the tapered shoulder 136 is located at a small axial distance from the end of the cup shaped body 74 to form a gap 370. The gap 370 allows a portion of the exiting cooling flow from the vent outlets 50 of the rotary drive tube 38 to pass along the tapered shoulder 136 and mix with the propellant gases in the enlarged diameter region 134 before being discharged through the diffuser plate 34.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A device for cooling a gun barrel with a cooling media, the device comprising:

a muzzle assembly having:

a shaft, the shaft having a first end and an axial opposite second end with a length between the first and second ends, the second end of the shaft being adapted and configured to releasably connect to an end of a gun barrel, the shaft having a bore, the bore of the shaft being adapted and configured to allow a round discharged from the gun to pass through the shaft from the second end of the shaft to the first end of the shaft;

a baffle operatively connected at the first end of the shaft;

a turbine assembly operatively connected to the shaft adjacent the first end of the shaft, the turbine assembly have a plurality of turbine blades downstream of the baffle and the first end of the shaft, the plurality of turbine blades being adapted and configured to rotate relative to the shaft;

a compressor assembly operatively connected to the shaft and disposed between the first end of the shaft and the second end of the shaft, the compressor assembly having a plurality of compressor blades, the compressor blades being adapted and configured to rotate relative to the shaft; and a rotary drive tube operatively connected to a radially outward region of at least one turbine blade and a radially outward region of at least one compressor blade, the rotary drive tube being adapted and configured to rotate relative to the shaft and rotate with the plurality of a turbine blades and the plurality of compressor blades, the rotary drive tube having a plurality of outlet vents downstream of the plurality of compressor blades.

2. The device of claim 1, further comprising:

a heat exchanger upstream of the muzzle assembly, the heat exchanger being adapted and configured to be removably connected with the muzzle assembly adjacent the second end of the shaft, the heat exchanger comprising an intake and a discharge, and at least one cooling fin, the intake being adapted and configured to direct the cooling media onto the at least cooling fin, the discharge being aligned with and adapted and configured to direct the cooling media from the at least one cooling fin to the plurality of compressor blades.

3. The device of claim 2, wherein the heat exchanger further comprises:

an outer shell;

a plurality of segments contained within the outer shell, the plurality of segments being radially movable within the outer shell;

a locking nut removably connectable with the outer shell;

wherein the outer shell and at least one of the segments has cooperating tapered surfaces such that removably connecting the locking nut with the outer shell moves the at least one segment radially inward in the outer shell.

4. The device of claim 2 wherein the heat exchanger comprises a chamber defined by an outer shell with a plurality of fins projecting radially inward from the outer shell.

5. The device of claim 2 wherein the heat exchanger comprises a center tube with a plurality of fins projecting radially outward from the center tube.

6. The device of claim 5 wherein the center tube is adapted and configured to supercircumjacently receive the barrel of the gun.

7. The device of claim 1 further comprising:

a tube operatively and removably connectable to the muzzle assembly, the tube being radially outward of the rotary drive tube, the tube having vents that direct effluent from the outlet vents of the rotary drive tube away from the muzzle assembly.

8. The device of claim 1 further comprising:

a shield operatively and repositionally connected to the muzzle assembly, the shield being radially outward of the rotary drive tube, the shield being adapted and configured to selectively directionally deflect effluent from the outlet vents of the rotary drive tube away from the muzzle assembly.

9. The device of claim 1, wherein the baffle is conically shaped and arranged to expand outward to the turbine blades.

10. The device of claim 1 wherein a majority of the turbine blades are connected to the rotary drive tube.

11. The device of claim 1 wherein a majority of the compressor blades are connected to the rotary drive tube.

12. The device of claim 1 wherein the plurality of compressor blades comprises a first set of blades with a first pitch and a second set of blades having a second pitch, the first pitch being different than the second pitch.

13. The device of claim 1 wherein the plurality of compressor blades comprises a first set having a first number of blades in the first set and a second set having a second number of blades in the second set, the first number of blades being different than the second number of blades.

14. The device of claim 1 wherein the turbine assembly further comprises a turbine bearing, and wherein the turbine assembly is adapted and configured to allow the cooling media to cool the turbine bearing.

15. The device of claim 1, wherein the compressor assembly comprises a compressor bearing, and wherein the compressor assembly is adapted and configured to allow the cooling media to cool the compressor bearing.

16. The device of claim 1, further comprising a diffuser plate downstream of the turbine assembly, the diffuser plate having outlet openings, the outlet openings being adapted and configured to direct a flow of propellant gases from the baffle and turbine away from the muzzle assembly, the diffuser plate having a muzzle opening coaxially aligned with and spaced from the first end of the shaft and adapted to allow passage of the round therethrough.

17. The device of claim 16 wherein the openings of the diffuser plate are adapted and configured to straighten a flow of the propellant gases flowing though the diffuser plate.

18. The device of claim 16 wherein the openings of the diffuser plate are adapted and configured to direct a flow of the propellant gases flowing though the diffuser plate in a direction of at least one of radially away from the diffuser plate and upstream of the diffuser plate.

19. The device of claim 1 wherein the cooling media is ambient air.

20. The device of claim 1 further comprising a suppressor removably connectable to the muzzle assembly downstream of the turbine assembly.

* * * * *